US009163506B2

(12) United States Patent
Ellis

(10) Patent No.: US 9,163,506 B2
(45) Date of Patent: Oct. 20, 2015

(54) ENGINE

(75) Inventor: Paul Fredric Ellis, London (GB)

(73) Assignee: Two Stroke Developments Limited, Stanmore (GB)

( * ) Notice: Subject to any disclaimer, the term of this patent is extended or adjusted under 35 U.S.C. 154(b) by 0 days.

(21) Appl. No.: 13/575,453

(22) PCT Filed: Jan. 27, 2011

(86) PCT No.: PCT/GB2011/050132

§ 371 (c)(1), (2), (4) Date: Jul. 26, 2012

(87) PCT Pub. No.: WO2011/092501

PCT Pub. Date: Aug. 4, 2011

(65) Prior Publication Data

US 2012/0298065 A1 Nov. 29, 2012

(30) Foreign Application Priority Data

Jan. 27, 2010 (GB) ..... 1001276.3

(51) Int. Cl.

| | |
|---|---|
| ***F01L 5/00*** | (2006.01) |
| ***F01L 7/00*** | (2006.01) |
| ***F01B 13/06*** | (2006.01) |
| ***F01L 5/06*** | (2006.01) |
| ***F02B 75/04*** | (2006.01) |

(Continued)

(52) U.S. Cl.

CPC ..... *F01B 13/068* (2013.01); *F01L 5/06* (2013.01); *F02B 75/04* (2013.01); *F01L 7/04* (2013.01); *F02B 57/06* (2013.01)

(58) Field of Classification Search

CPC ..... F01L 5/04; F01L 5/02; F01L 3/20; F01L 7/00; F01L 3/08; F01L 7/04; F01L 7/16; F01L 7/021

USPC ..... 123/188.4, 188.5, 190.12

See application file for complete search history.

(56) References Cited

U.S. PATENT DOCUMENTS

| | | | |
|---|---|---|---|
| 1,313,569 | A | 8/1919 | Wilks |
| 1,370,542 | A | 3/1921 | Hutchinson |
| 1,529,687 | A | 3/1925 | Bowen |

(Continued)

FOREIGN PATENT DOCUMENTS

| | | | |
|---|---|---|---|
| CA | 1129346 | A1 | 8/1982 |
| DE | 2943633 | A1 | 5/1981 |

(Continued)

OTHER PUBLICATIONS

International Search Report dated Jun. 30, 2011 for PCT/GB2011/050132, from which the instant application is based, 3 pgs.

(Continued)

*Primary Examiner* — Lindsay Low
*Assistant Examiner* — Syed O Hasan
(74) *Attorney, Agent, or Firm* — Fredrikson & Byron, P.A.

(57) ABSTRACT

An internal combustion engine comprises a movable piston (2), at least one inlet port (21*a*, 21*b*) for a working fluid, at least one transfer/scavenging port (14) for a working fluid, internally to a working space, and at least one exhaust port (16) from the working space, in which the said at least one transfer/scavenging port (14) is provided with closure means including a reciprocatable sleeve (1) which is parallel to the axis of and linked synchronously with, the piston movement.

49 Claims, 10 Drawing Sheets

(51) Int. Cl.

| | |
|---|---|
| *F01L 7/04* | (2006.01) |
| *F02B 57/06* | (2006.01) |

(56) References Cited

U.S. PATENT DOCUMENTS

| | | | | | |
|---|---|---|---|---|---|
| 1,808,083 | A | | 6/1931 | Tibbetts | |
| 2,237,989 | A | | 4/1941 | Herrmann | |
| 2,261,567 | A | * | 11/1941 | Scott | 123/65 BA |
| 2,304,694 | A | | 12/1942 | George | |
| 2,334,917 | A | | 11/1943 | Ford | |
| 3,450,121 | A | * | 6/1969 | Roosa | 123/502 |
| 3,485,179 | A | * | 12/1969 | Dawes | 418/86 |
| 3,517,651 | A | * | 6/1970 | Graybill | 123/44 R |
| 4,487,172 | A | * | 12/1984 | Suhre | 123/81 C |
| 4,635,590 | A | * | 1/1987 | Gerace | 123/27 R |
| 4,996,953 | A | | 3/1991 | Buck | |
| 5,113,805 | A | * | 5/1992 | Kawamura | 123/21 |
| 5,623,894 | A | | 4/1997 | Clarke | |
| 2003/0094164 | A1 | | 5/2003 | Lowi, Jr. et al. | |
| 2010/0192923 | A1 | | 8/2010 | Cox | |
| 2012/0085305 | A1 | | 4/2012 | Cleeves et al. | |
| 2012/0204841 | A1 | | 8/2012 | Hofbauer et al. | |
| 2013/0276762 | A1 | | 10/2013 | Hofbauer | |

FOREIGN PATENT DOCUMENTS

| | | | |
|---|---|---|---|
| DE | 19503444 | | 5/1996 |
| EP | 0295823 | A2 | 12/1988 |
| GB | 190919452 | | 2/1910 |
| GB | 158532 | A | 4/1921 |
| GB | 266106 | A | 2/1927 |
| GB | 377614 | | 7/1932 |
| GB | 428893 | A | 5/1935 |
| GB | 433022 | A | 8/1935 |
| GB | 442126 | A | 2/1936 |
| GB | 497300 | | 12/1938 |
| GB | 503987 | A | 4/1939 |
| GB | 855553 | | 12/1960 |
| GB | 1429341 | A | 3/1976 |
| GB | 2019487 | | 10/1979 |
| GB | 349069 | A | 5/1981 |
| GB | 2369859 | | 6/2002 |
| GB | 2376719 | | 12/2002 |
| GB | 2432398 | A | 5/2007 |
| GB | 2463204 | A | 3/2010 |
| GB | 2482565 | | 6/2012 |
| GB | 2453131 | | 9/2012 |
| GB | 2491297 | A | 11/2012 |
| WO | 8404354 | A1 | 11/1984 |
| WO | 9849436 | | 11/1998 |
| WO | 9849437 | | 11/1998 |
| WO | 0223025 | | 3/2002 |
| WO | 2006002982 | | 1/2006 |
| WO | 2007009731 | A1 | 1/2007 |

OTHER PUBLICATIONS

Search Report dated Jan. 19, 2011 for related Application No. GB1001276.3, 2 pgs.

Van Valkenburgh, "Technology Double Whammy", Popular Mechanics, Sep. 1992, 3 pages.

"EcoMotors." Wikipedia, page was last modified on Dec. 17, 2013. Retrieved from: http://en.wikipedia.org/wiki/EcoMotors on Feb. 25, 2014.

EcoMotors opoc™ Dual-Module video, no date. Viewable at http://www.ecomotors.com/videos/opoc-dual-module on Feb. 25, 2014.

"Technology—Pinnacle Engines." Retrieved from: http://pinnacle-engines.com/technology/ on Feb. 25, 2014.

* cited by examiner

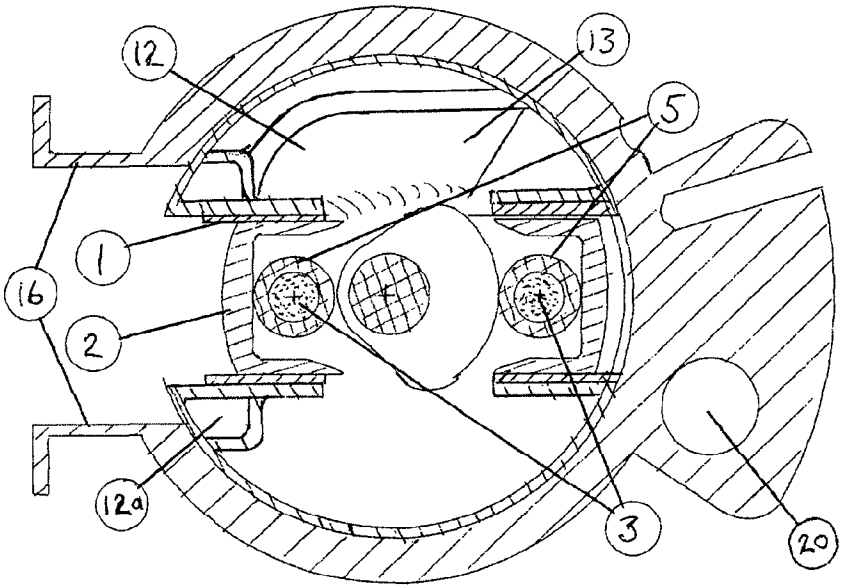
Figure 1a Section Through Piston/Cam Assembly

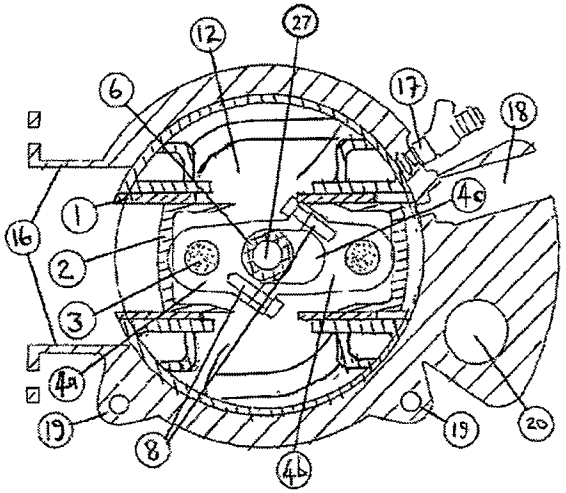
Figure 1b Section Through Piston/Linking Rod Assembly

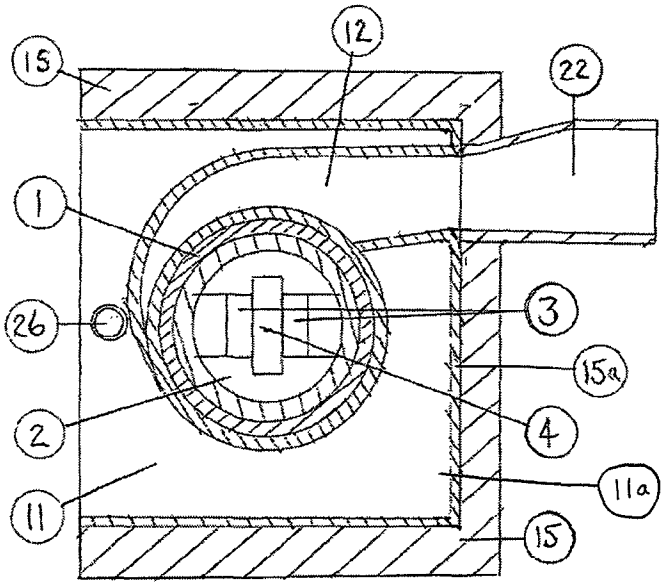
Figure 1c Section Through Lower Piston

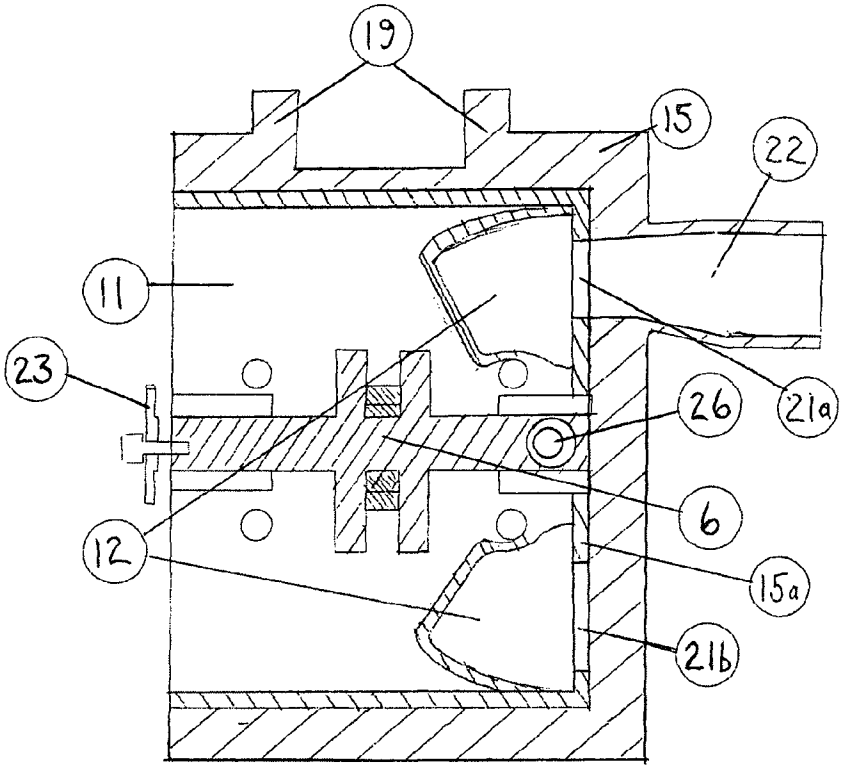
Figure 1d Section Through Centre of Camshaft

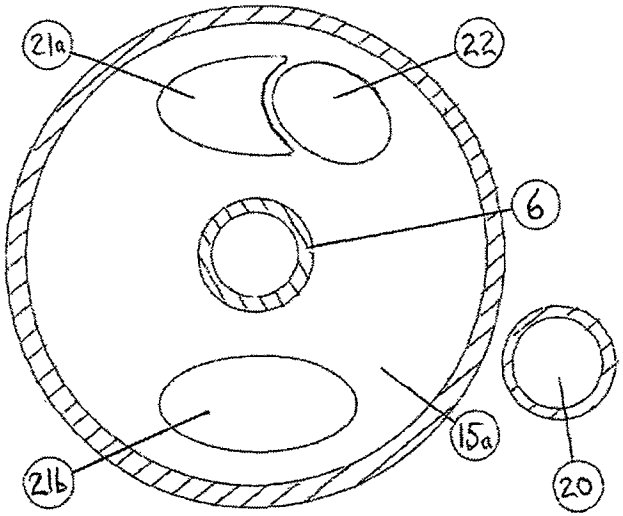
Figure 1e Section of Outer Casing Rear Wall

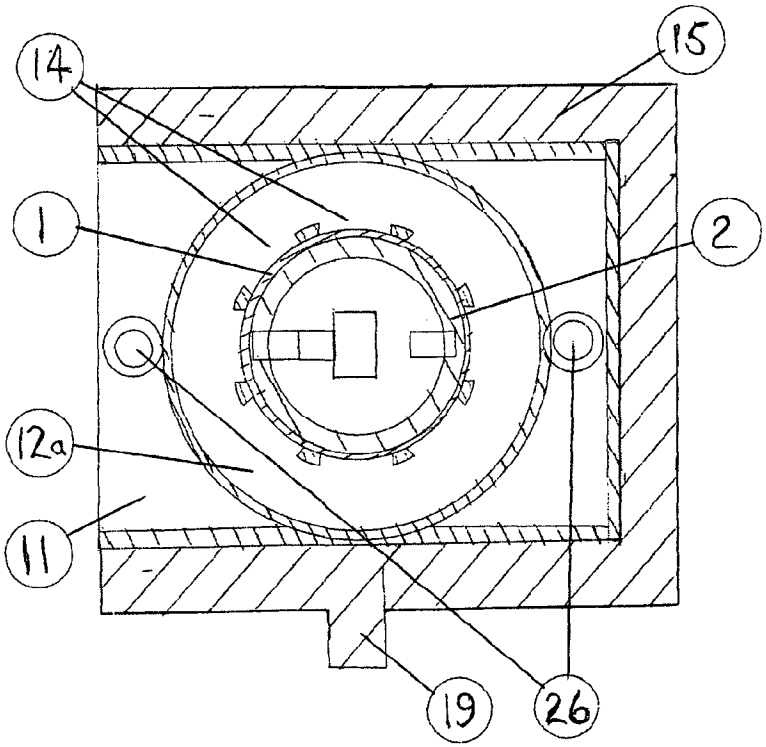
Figure 1f Section Through Upper Piston and Cylinder

Pistons/Sleeve Valves/Linking Rods/Cam Mechanisms
Isometric View

Figure 4 Section Through Piston/Outer Casing

ENGINE

RELATED APPLICATIONS

This application is a US 371 National Stage Application of International Application No. PCT/GB2011/050132 filed Jan. 27, 2011, claiming priority to British Application No. 1001276.3 filed Jan. 27, 2010, the teachings of which are incorporated herein by reference.

This engine relates to improvements in rotary valve internal combustion piston engines either of the two-stroke or four-stroke cycle type, and more particularly concerned with a timing device for internal combustion piston engines of the kind in which a single reciprocating sleeve valve controls the opening and closing of the engine inlet ports only.

Such sleeve valves are well known, but suffer from the disadvantage that they require a separate auxiliary drive mechanism, which adds both weight and complexity to any internal combustion engine utilising such a device and they do not significantly alter the timing events within the engine.

The preferred embodiment of this device is to employ it within a two-stroke cycle engine. In such an engine, in which the prior art is well known, scavenging normally takes place via ports cut into the cylinder walls, which are uncovered by the piston on its descending, or power stroke, and covered over by the piston on its ascending, or compression stroke.

The disadvantage of this is that the port timings are, of necessity, symmetrical about the bottom dead centre position of the piston. This means that, in order to open the exhaust ports sufficiently in advance of the transfer ports and allow the exhaust pressure to fall to a value less than that in the transfer ports, the exhaust ports must open very early after the piston top dead centre position.

Also, because of the symmetrical nature of the port timing, the exhaust ports must always close an equal degree after the transfer ports have closed and this will always result in charge loss into the exhaust, causing a great loss in efficiency and a serious pollution of the environment in which the engine operates, unless a resonant type of exhaust pipe is fitted which will set up pressure pulses within the system, timed to coincide beneficently with the port timing events.

Unfortunately, such devices also only operate within a very narrow speed range, on any engine to which they are fitted.

In addition, the higher the operating speed of the engine, the earlier the exhaust ports must open, as the time available for these events to take place is much reduced. This results in very deep ports, which are inimical to slow running, and this is the reason why two-stroke porting design is usually a compromise.

Another disadvantage of such an arrangement is that a considerable proportion of the power stroke is devoted to the porting, leading to a further loss of efficiency as the exhaust port must open before the expanding gases have been able to convert all of their energy into useful work on the piston right up to the bottom dead centre position.

With the above difficulties in mind, a number of alternatives to the conventional two-stroke engine configuration of Clerk have been proposed.

In some of these use is made of relatively movable sliding vanes which cooperate with a cam surface disposed on the end surface of the vanes. As the vanes ride over the cam surface they are caused to move longitudinally and vary the volume of a working chamber. Valves are provided as openings in an outer shell which moves relative with the cam surface.

A particular disadvantage of this prior art is that the cam surfaces also act as piston surfaces; consequently the force applied to the piston is converted into rotary motion with reduced efficiency and there is excessive wear of parts.

The present invention concerns itself with port timing, utilising means extraneous to the piston/cylinder/engine casing members themselves. It is an object of the present invention to provide an alternative configuration for a two-stroke engine.

According to a first aspect of the invention, there is provided an internal combustion engine comprises a movable piston, at least one inlet port for a working fluid, at least one transfer/scavenging port for a working fluid, internally to a working space, and at least one exhaust port from the working space, in which the said at least one transfer/scavenging port is provided with closure means including a reciprocatable sleeve which is parallel to the axis of, and linked synchronously with, the piston movement.

Such closure means acts as a sleeve-valve.

Preferable and/or optional features of the first aspect of the invention are set forth in claims 2 to 10, inclusive.

According to a second aspect of the invention, the invention allows for the reciprocal motion of the pistons to be activated and controlled by means of a pair of fixed central cam mechanisms preferably separated from the output shaft, such reciprocal motion initiated by means of pairs of contact rollers, themselves mounted on a fixed shaft contained within the said pistons.

The cams thus described being of an eccentric nature, results in reciprocation of the two linked pistons between top and bottom dead centre positions.

There is an advantage in utilising such a cam mechanism in that, by so shaping such cams, a considerable portion of the cycle of piston movement may consist of a stationary phase, or dwell, at both top and bottom dead centre positions.

Such a period of dwell of the pistons has several advantages. Firstly, a large degree of dwell at the top dead centre position allows the heat exchange of combustion to occur at constant volume before the expansion phase of the cycle commences. Secondly, Homogeneous Charge Compression Ignition may be fully exploited across all operating speeds and loads of the engine. Thirdly, because the sleeve-valve mechanism allows for the timing of porting events independent of piston stroke position, the exhaust port opening may easily be delayed until the pistons have traversed the whole of the power stroke, that is, at bottom dead centre, resulting in a power stroke with a more complete expansion ratio.

Correspondingly, a further advantage of the invention as described is the ability to open the transfer/scavenging ports at the ideal time for efficient exhaust scavenging and to close the said transfer/scavenging ports a great deal later than the exhaust ports are closed. By such means, the escape of fresh charge into the exhaust may be eliminated entirely. The closing of the transfer ports may be delayed to take place only a few degrees before top dead centre, whereby the majority of charge compression may be achieved by an external compressor, thus reducing pumping losses suffered by the piston.

By utilising an exhaust pressure driven compressor to provide charge compression, excess exhaust energy may be converted to useful work, thus eliminating the need for the piston to do all the work of charge compression, resulting in better engine efficiency.

This whole pattern of port timing allows for a more complete expansion ratio of the working gases on the pistons, combined with a much reduced compressive workload done by the pistons, further increasing overall engine efficiency.

A further aspect of the invention is the use of a split, bifurcated induction tract whereby scavenging air only may be supplied by an external compressor unit powered either mechanically, electrically, or from a pressurised storage reservoir. Fresh, pressurised charging air may then be supplied by means of an exhaust-driven turbine compressor or similar device.

Another aspect of the invention not so far described, is a feature designed to eliminate blow-by of exhaust products past the piston skirt and into the crankcase and oil sump. This is achieved by including a circumferential groove, or passage connected by smaller passages to the inlet or scavenge port. As the inlet or scavenge port contains fresh air or air/fuel mixture at high pressure from an external pumping device, this high pressure gas is able to surround the circumference of the piston below the ports, but between the piston crown and skirt at all positions between top and bottom dead centre.

Such a high pressure region thus formed prevents any hot exhaust products that may have bypassed the topmost piston rings from travelling further past the piston skirt.

The invention will be further described with reference to the accompanying drawings in which: —

FIGS. 1*a*, 1*b*, 1*c*, 1*d*, 1*e* and 1*f* show in cross section the working parts of an internal combustion engine of the two-stroke type embodying the features of the invention as a preferred embodiment.

Figure 2:
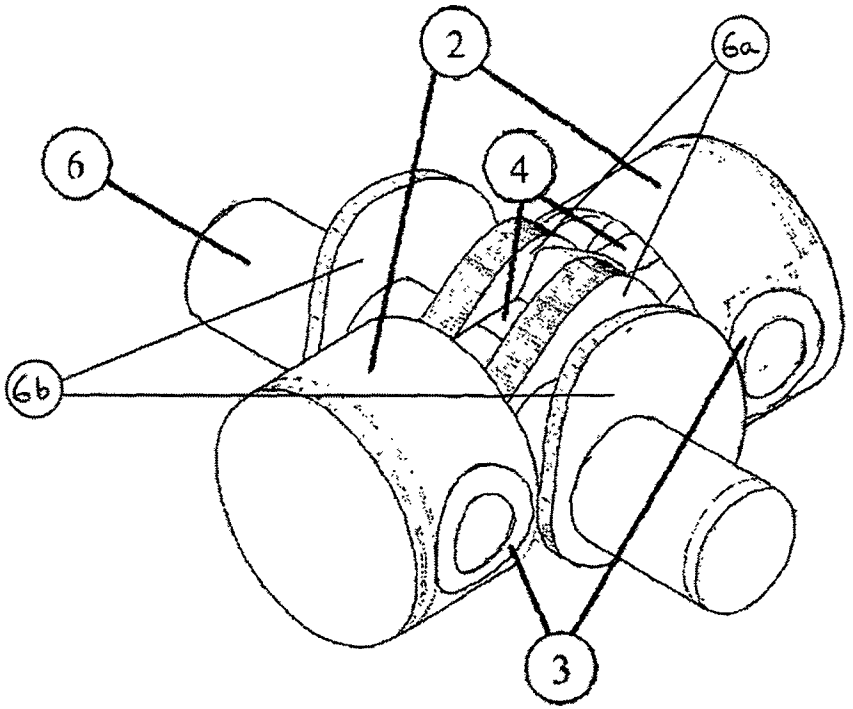
FIG. 2 shows the piston, linking rod and cam mechanism in isometric detail view.

In the preferred embodiment of a rotary valve internal combustion piston engine, a pair of reciprocatable sleeves (1) act as working cylinders. Although a pair of sleeves is suggested, if only piston is provided, then only one sleeve may be required.

Each sleeve surrounds a working reciprocatable piston (2), such piston containing a fixed shaft (3) fitted at right angles to the cylinder bore and containing a pair of rotating rollers mounted upon them (5), such rollers being in constant contact with a fixed pair of cams (6*a*) which are integral to a fixed central shaft (6). See FIGS. 1*a*, 1*b* and 3.

Figure 5:
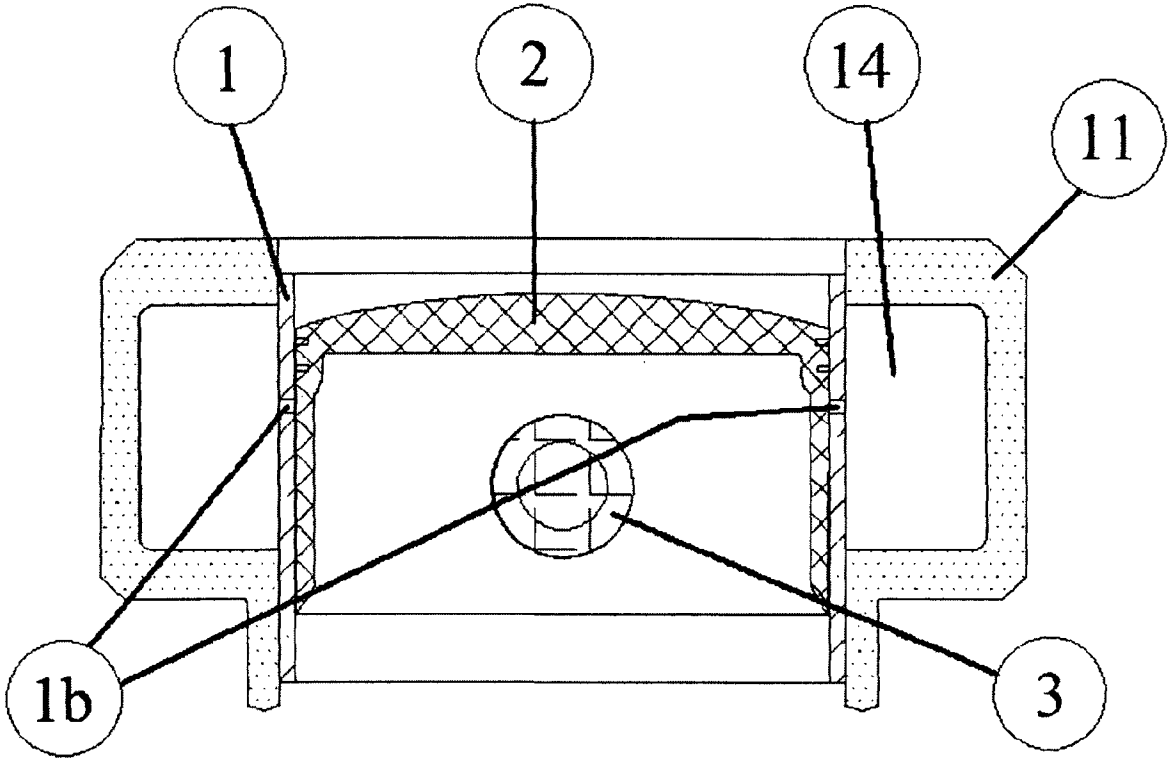
FIG. 5 shows the high pressure air channels surrounding the piston in detail view in accordance with a third embodiment of the engine.

Each sleeve may be pierced around its circumference by a number of equally spaced holes (1*b*), so positioned as to be below the level of the piston rings at the piston bottom dead centre position. The purpose of such holes is to allow high pressure air contained within transfer/scavenging passages, as further described (14), to enter any gap between the piston (s) (2), and the sleeve(s) (1), and below the piston rings which seal this gap from the combustion space(s), such air being under sufficient pressure as to prevent the leakage of oil from a reservoir (11*a*), formed within a cylinder block (11), as further described, into such combustion space(s). See FIG. 5.

On reciprocation of the cylinder sleeves (1) the transfer/scavenging ports (14) are covered or uncovered according to the degree of reciprocation of the sleeves (1).

Contained within the sleeves are the pair of pistons (2) linked together by a linking bar (4*a* and 4*b*) which is pierced by two pins (3) at right angles to its surface. These pins preferably have four said rollers (5) mounted two at each side of the linking bar, each roller acting as a follower of a pair of cams, which are positioned each side of the linking bar so as to always be in contact with a cam surface. The pair of cams are formed as an integral part of the fixed central shaft (6). See FIGS. 1*a-d* and FIGS. 2, 3.

Such a linking bar is preferably formed in two halves (4*a*, 4*b*) as shown and joined together by means of compression screws (8).

An elongated slot (4*c*) is formed within the linking bar to allow clearance for the drive shaft between top and bottom dead centre positions of the pistons.

Figure 3:
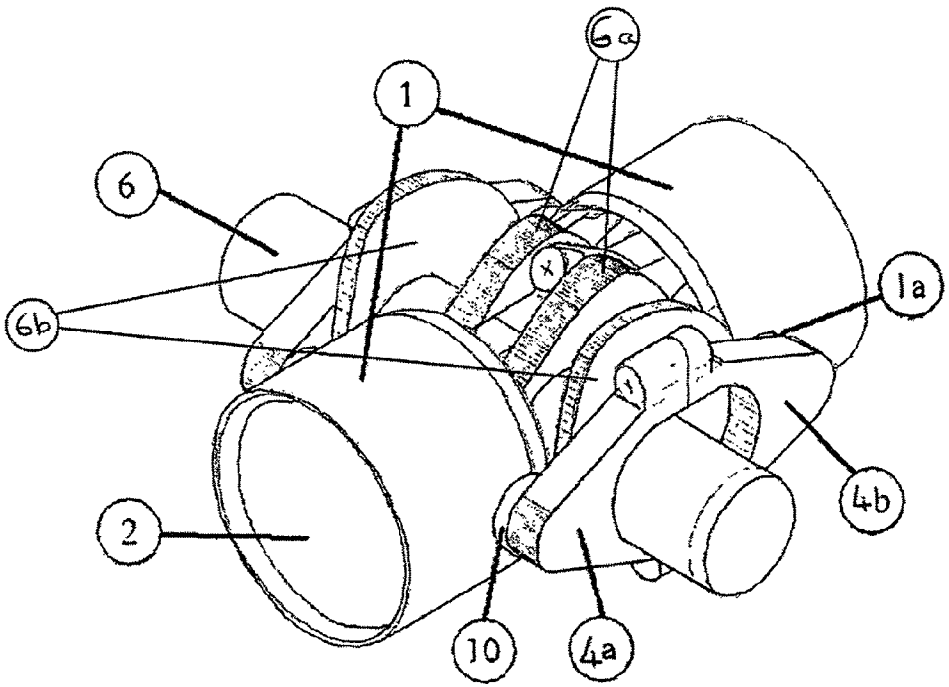
FIG. 3 shows the piston-sleeve valve, linking rods, and cam mechanisms in isometric detail view.

To either side of these cams are a further pair of cams (6*b*), such cams also being an integral part of the previously mentioned shaft (6) and mounted out of phase with the piston activating pair, so as to provide reciprocating motion to the cylinder sleeves of the same order of magnitude as the piston motion but at a time later acting than that of the piston(s). As shown in FIG. 3, a pair of spacers 10 is positioned between the linking bar halves 4*a*, 4*b* and reciprocatable sleeves 1 on opposing sides of the pistons 2, and as such (and perhaps as best shown by FIG. 3), the spacers 10 are aligned with and have rolling contact with the cams 6*b*.

Sleeve motion is provided by means of a pair of short shafts (1*a*) integral with the lower end of each sleeve and projecting at right angles to the sleeve bore and at either side of said sleeve. See FIG. 3.

In the preferred embodiment, each pair of working piston/sleeve assemblies are contained within a rotatable housing (11) which rotates about the shaft (6) integral with the activating cams. The rotatable housing (11) acts as a rotating cylinder block. Such housing itself is integral with a separate drive shaft (23) for power take-off. See FIGS. 1*c*, 1*d*.

This rotatable housing is further contained within a shell-like sealed chamber (15) having a cylindrical interior, as shown. This chamber contains a single port (16) for exhausting waste products from each working cylinder in turn, on rotation of the said housing. Such a port is so positioned as to allow communication with the, or each, working cylinder space at, or immediately before, bottom dead centre position of the, or each, piston.

Such a chamber also contains a combustion space provided with threaded holes (17 and 18), as shown, to contain a sparking plug, or similar ignition device and/or fuel injection device(s). Such holes are positioned preferably diametrically opposite the exhaust port within the said housing, so as to communicate with the, or each, working cylinder at, or immediately before, top dead centre position of the, or each, piston. See FIGS. 1*a*, 1*b*.

Figure 4:
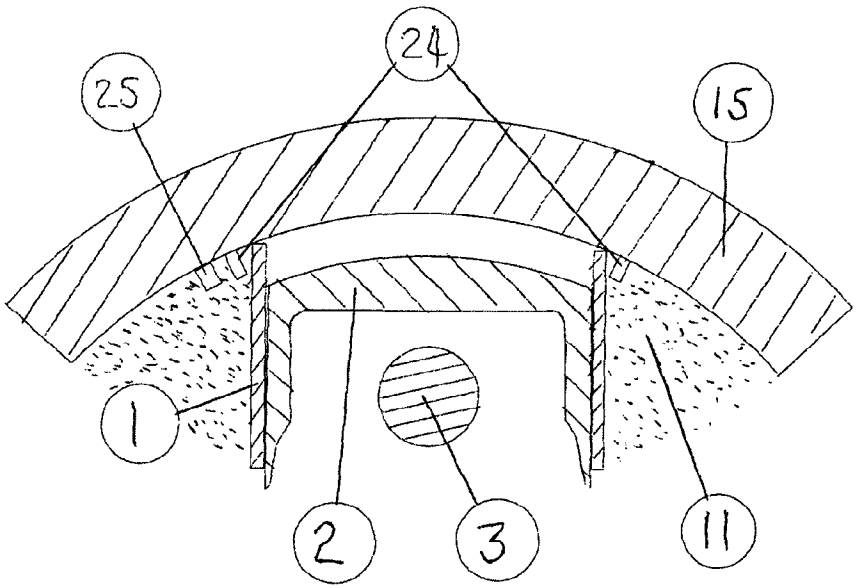
FIG. 4 shows in cross section a portion of the piston and sleeve assembly and outer casing in accordance with a second embodiment of the invention.

Positioned at either side of each cylinder assembly and in contact with the inner wall of the cylindrical chamber may be positioned a pair of spring-loaded gas seals (24) and a single spring-loaded oil scraper bar (25) as shown. See FIG. 4.

One wall (15*a*) of the cylindrical chamber (15) may contain at least one, and in this case two, induction ports (21*a* and 21*b*) positioned diametrically about the central fixed shaft which may communicate with passages (12) connected tangentially to a swirl-chamber, or chambers (12*a*), each surrounding the cylinder transfer/scavenging ports (14) contained within, and integral with, the rotatable cylinder housing (11).

The outer wall of the chamber (15) may be linked to a bifurcated inlet tract (22) as shown. The tract which is in primary communication with the inlet port(s) (21*a*, 21*b*) may connect with a scavenging pump, or pumps, or an air reservoir, or both. The tract in secondary communication with the inlet port(s) may be connected to a high-pressure air supply, for example an exhaust-driven turbocharger, in order to pressure-charge each cylinder prior to combustion.

The rotatable cylinder housing (11) may preferably contain within its structure a reservoir space (11*a*) of sufficient volume to hold a significant amount of lubricating oil, such oil to be re-circulated at a flow rate great enough to provide both adequate cooling and lubrication of the piston/sleeve/cam roller and linkage assemblies contained therein. The oil supply may be circulated by means of oil-ways (26) within the said housing and appropriate drillings (27) in the central shaft to communicate with the said oil-ways.

Mounting lugs (19) may be formed integral with the outer casing (15) as well as provision for recirculating coolant water via an integral coolant passage (20).

It is therefore possible to provide a, preferably two-stroke, engine in which the piston no longer controls the port timings. Instead, a cylinder liner or sleeve is made to reciprocate out of phase with the piston, or pistons, but having virtually the same stroke length. The liner sleeve has two diametrically opposed cylindrical driving pins at its lower end.

The (or each) reciprocating liner is sealed against compression by means of the inherent flexibility of its relatively thin wall thickness. Lubrication of the sleeve is achieved by pressure lubrication from oil feed holes in the cylinder casing mating with fine grooves machined on the outside walls of the liner below its upper edge.

One or more inlet ports are formed within the cylinder casing around the entire circumference of the cylinder bore and are covered and uncovered by the motion of the reciprocating liner which surroundingly encases the (or each) piston. Each port is separated from its adjacent ports by a narrow bridge.

The depth of the inlet ports is virtually equal to the piston stroke. This gives the maximum possible port area conducive to high gas flows through the ports.

Instead of using a crankshaft to reciprocate the pistons, a pair of cams integral with the drive shaft and having a gap between them to accommodate a flat tie bar, which links the pistons axially together in pairs, acts on matching pairs of cam rollers which sit either side of this bar on piston pins located beneath each piston crown and inside each piston.

The tie bar is slotted in the centre and is made in two parts to facilitate assembly. The slot is just large enough to clear the centre journal of the drive shaft and long enough to allow full piston movement between dead centres.

The cams are so shaped as to provide up to 120 degrees of dwell at both dead centre positions. The purpose of this is to allow all heat exchange to take place at constant volume. Alternatively, a scotch yoke arrangement could be used, but this would reduce piston dwell considerably.

By timing the porting by means other than the piston, the scavenging process is greatly improved. Short-circuiting is reduced, turbulence is increased, fuel loss is entirely eliminated, there is less mixing of scavenge air with exhaust gases, and none of the power stroke is lost to early exhaust opening. Late (at BDC) closing of the scavenging ports allows pressure charging of the engine after the scavenging of exhaust gases is complete.

The engine is scavenged by compressed air only, fuel being injected after the exhaust ports have fully closed. This may be achieved by means of an exhaust turbo-compressor alone, or combined with a separate scavenging pump, and possibly an air reservoir for starting purposes.

The invention utilises a single exhaust port having a total area greater than that of the working cylinder diameter and uncovered by a rotary closure means, in the form of a fixed, sealed, cylindrical casing, which fully encloses a rotating cylinder housing, itself containing the working piston/cylinder assembly(ies).

Fuel injection may be accomplished by means of the patented "Orbital" injection system, or similar. Ignition may be achieved by means of HCCI or "Smartplugs", (a plasma injection device). Both of these allow for ultra-lean mixtures to be burned.

An extra feature is the use of holes drilled through the cylinder liner above its bottom edge. These drillings communicate directly with the transfer/scavenging port(s). This allows high-pressure air to pass through the liner onto the piston skirt, below the compression and oil scraper rings.

The purpose of this is to prevent exhaust blow-by into the crankcase, which would normally contaminate the oil contained in the sump.

The above described reciprocal piston and sleeve motion is accompanied by up to 120 degrees of dwell at both top and bottom dead centre positions of the said components. Such dwell is preferably achieved by means of suitably shaped cams integral to the central fixed shaft. Such arrangement allows for heat exchange to always take place at constant volume as in the ideal Otto cycle of operations within a heat engine.

The oil reservoir is formed within the rotatable inner housing, into which such oil may be recirculated and in which the oil is thrown by centrifugal force onto moving parts contained within the inner housing to enable both cooling and lubrication of such moving parts.

The embodiments described above are provided by way of examples only, and various other modifications will be apparent to persons skilled in the art without departing from the scope of the invention as defined by the appended claims.

The invention claimed is:

1. An internal combustion engine comprising:
- a movable piston reciprocatable within a cylinder;
- at least one inlet port for a working fluid;
- at least one transfer/scavenging port for a working fluid, leading to a working space; and
- at least one exhaust port from the working space;
- wherein at least one of said ports is provided with a closure means, the closure means including a reciprocatable sleeve arranged to reciprocate parallel with axis of the piston movement;
- wherein the engine further comprises a single camshaft assembly having combined function of reciprocating the sleeve and inducing a period of dwell of the piston during cycle of the piston movement.

2. An internal combustion engine as claimed in claim 1, configured so that timing of porting events during the cycle of piston movement is controllable by reciprocation of the reciprocatable sleeve and independently of position of the piston within the cylinder.

3. An internal combustion engine comprising:
- a movable piston reciprocatable within a cylinder;
- at least one inlet port for a working fluid;
- at least one transfer/scavenging port for a working fluid, leading to a working space; and
- at least one exhaust port from the working space;
- wherein the at least one exhaust port is provided with a closure means, the closure means including a reciprocatable sleeve arranged to reciprocate parallel with the axis of the piston movement;
- wherein timing of porting events during cycle of piston movement is controllable by reciprocation of the reciprocatable sleeve;
- wherein the engine is configured so that the at least one exhaust port is uncovered by the reciprocatable sleeve substantially as the piston arrives in a bottom dead center position within the cylinder; and
- wherein the engine further comprises a common camshaft assembly having combined function of reciprocating the reciprocatable sleeve and inducing a period of dwell of the piston during the cycle of the piston movement.

4. An internal combustion engine as claimed in claim 1, wherein the single camshaft assembly comprises at least one cam for inducing the period of dwell of the piston.

5. An internal combustion engine as claimed in claim 4, wherein the at least one cam is shaped so that a major portion of the cycle of piston movement consists of dwell.

6. An internal combustion engine as claimed in claim 5, wherein the at least one cam is shaped so that the period of dwell of the piston is sufficient for substantially all of the heat exchange of combustion to take place in the cylinder at constant volume.

7. An internal combustion engine as claimed in claim 6, wherein the at least one cam is shaped so that the period of dwell of the piston induced is no greater than 120 degrees.

8. An internal combustion engine as claimed in claim 4, wherein the single camshaft assembly includes at least one further cam for inducing reciprocating movement of the sleeve.

9. An internal combustion engine as claimed in claim 8, wherein the at least one cam and the at least one further cam are integrally formed on the single camshaft assembly.

10. An internal combustion engine as claimed in claim 9 wherein the at least one cam and the at least one further cam are mounted out of phase on the single camshaft assembly.

11. An internal combustion engine as claimed in claim 9, including a rotatable inner housing and a sealed outer fixed housing, the rotatable inner housing being rotatable within the sealed outer fixed housing, and the moveable piston and the reciprocatable sleeve being contained within the rotatable inner housing.

12. An internal combustion engine as claimed in claim 11 wherein the at least one inlet port is provided in the outer fixed housing and the at least one inlet port in the outer fixed housing is alignable on rotation of the inner housing with a transfer/scavenging passage in the rotatable inner housing which leads to the working space.

13. An internal combustion engine as claimed in claim 11, wherein the inner housing includes the piston and the sleeve arranged to reciprocate parallel to the axis of, and out of phase with, the piston movement, wherein the inner housing is rotatable about the single camshaft assembly and rotation of the inner housing provides said reciprocal movement to both the piston and the sleeve, wherein the single camshaft assembly provides said reciprocal movement to the piston via at least one rotating cam follower mounted on a further shaft within the piston, and the single camshaft assembly further provides said reciprocal movement to the sleeve via at least one rotating cam follower protruding from the sleeve at a lower end thereof.

14. An internal combustion engine as claimed in claim 9, wherein the piston comprises two distinct pistons, wherein the two said pistons are linked together to form an opposing pair by means of at least one flat linking element which provides anti-rotation means, as well as linking means, and includes a central slot appropriate to straddle the single camshaft assembly.

15. An internal combustion engine as claimed in claim 14 wherein the linking element is formed in two halves joined together by means of compression screws to define the central slot.

16. An internal combustion engine as claimed in claim 1 including a plurality of transfer/scavenging ports formed within the cylinder around the circumference of the cylinder bore, each port being separated from its adjacent ports by a narrow bridge.

17. An internal combustion engine as claimed in claim 11 including an exhaust port in the outer fixed housing wherein the exhaust port from the working space is alignable on rotation of the inner housing with the exhaust port in the outer fixed housing to permit exhaust of the combustion products from the working space.

18. An internal combustion engine as claimed in claim 17 wherein the exhaust port in the outer housing has a total area greater than that of the working cylinder diameter.

19. An internal combustion engine as claimed in claim 17 wherein the exhaust port in the outer fixed housing is positioned so that rotation of the internal housing allows communication of the exhaust port in the outer fixed housing with the working space at, or immediately before, the bottom dead centre position of the piston.

20. An internal combustion engine as claimed in claim 11 configured so that on rotation of the inner housing, the at least one transfer/scavenging port is closed by the reciprocatable sleeve after the exhaust port to reduce or eliminate the escape of fresh charge into the exhaust.

21. An internal combustion engine as claimed in claim 11 configured so that rotation of the inner housing causes the at least one transfer/scavenging port to be closed by the reciprocatable sleeve substantially at the top dead center position of the piston.

22. An internal combustion engine as claimed in claim 1, wherein an inlet tract leading to the said at least one inlet port is bifurcated to allow streams of scavenging and charging air to be of separate origin, such as from a mechanical pump for scavenging air and from an exhaust turbocharger for charging air.

23. An internal combustion engine as claimed in claim 1 where the reciprocatable sleeve includes a series of equally spaced small holes around its periphery which allow communication between high pressure air within the or each transfer/scavenging port and any gap between the or each piston and its respective sleeve below piston rings, whereby exhaust blow-by into an oil sump is substantially avoided.

24. An internal combustion engine as claimed in claim 11, wherein the rotatable inner housing is integral with a main drive shaft for power take-off.

25. An internal combustion engine as claimed in claim 11, wherein an oil reservoir is formed within the rotatable inner housing, into which such oil may be recirculated and in which the oil is thrown by centrifugal force onto moving parts contained within the inner housing to enable both cooling and lubrication of such moving parts.

26. An internal combustion engine as claimed in claim 11, wherein flat rectangular section sprung sealing strips are set in appropriate grooves either side of each working cylinder, set within the outer face of the rotatable inner housing and in contact with an inner face of the outer fixed housing, said strips forming a fluid-tight seal therebetween.

27. An internal combustion engine as claimed in claim 1 wherein the single camshaft assembly includes at least one cam for inducing the dwell of the piston, and includes at least one further cam for inducing reciprocating movement of the reciprocatable sleeve.

28. An internal combustion engine as claimed in claim 1, including a rotatable inner housing and a sealed outer fixed housing, the rotatable inner housing being rotatable within the sealed outer fixed housing, and the moveable piston and the reciprocatable sleeve being contained within the rotatable inner housing.

29. An internal combustion engine as claimed in claim 28 wherein the at least one inlet port is provided in the outer fixed housing and the at least one inlet port in the outer fixed housing is alignable on rotation of the inner housing with a transfer/scavenging passage in the rotatable inner housing which leads to the working space.

30. An internal combustion engine as claimed in claim 29 wherein the transfer/scavenging passage is connected tangentially to at least one chamber surrounding the cylinder transfer/scavenging ports.

31. An internal combustion engine as claimed in claim 4, including a rotatable inner housing and a sealed outer fixed housing, the rotatable inner housing being rotatable within the sealed outer fixed housing, wherein the inner housing includes the piston and the sleeve arranged to reciprocate parallel to the axis of, and out of phase with, the piston movement, wherein the inner housing is rotatable about the single camshaft assembly and rotation of the inner housing provides said reciprocal movement to both the piston and the sleeve, wherein the single camshaft assembly provides said reciprocal movement to the piston via at least one rotating cam follower mounted on a further shaft within the piston, and the single camshaft assembly further provides said reciprocal movement to the sleeve via at least one rotating cam follower protruding from the sleeve at a lower end thereof.

32. An internal combustion engine as claimed in claim 10, wherein the piston comprises two pistons, wherein the two said pistons are linked together to form an opposing pair by means of at least one flat linking element which provides anti-rotation means, as well as linking means, and includes a central slot appropriate to straddle the single camshaft assembly.

33. An internal combustion engine as claimed in claim 32 wherein the linking element is formed in two halves joined together by means of compression screws to define the central slot.

34. An internal combustion engine comprising:

a movable piston reciprocatable within a cylinder;

at least one inlet port for a working fluid;

at least one transfer/scavenging port for a working fluid, leading to a working space; and at least one exhaust port from the working space;

wherein at least one of said ports is provided with a closure means, the closure means including a reciprocatable sleeve arranged to reciprocate parallel with axis of the piston movement; and wherein reciprocal motion of the reciprocatable sleeve is linked to reciprocal motion of the piston via a common camshaft.

35. The internal combustion engine as claimed in claim 34, wherein the common camshaft includes at least one cam for inducing a period of dwell of the piston and at least one further cam for inducing reciprocating movement of the sleeve.

36. The internal combustion engine as claimed in claim 1, wherein the reciprocatable sleeve is a linear reciprocating sleeve.

37. The internal combustion engine as claimed in claim 3, wherein the timing of porting events during the cycle of piston movement is controllable independently of position of the piston within the cylinder.

38. The internal combustion engine as claimed in claim 37, wherein the timed porting events are exhaust porting events.

39. The internal combustion engine as claimed in claim 38, wherein the timed porting events are all porting events.

40. An internal combustion engine comprises comprising:

a movable piston, reciprocatable within a cylinder;

at least one inlet port for a working fluid;

at least one transfer/scavenging port for a working fluid, leading to a working space; and at least one exhaust port from the working space; and at least one shaft;

wherein at least one of said ports is provided with a closure means including a reciprocatable sleeve arranged to reciprocate linearly and parallel with axis of the piston movement;

wherein the engine further comprises at least one cam for inducing a period of dwell of the piston and comprises a sleeve driving mechanism for reciprocating the linear reciprocatable sleeve, the sleeve driving mechanism comprising at least one further cam for inducing reciprocating movement of the sleeve; and wherein the at least one cam and the at least one further cam are located on the at least one shaft.

41. The internal combustion engine as claimed in claim 1, wherein timing of porting events during the cycle of piston movement is controllable by reciprocation of the reciprocatable sleeve.

42. The internal combustion engine as claimed in claim 41, wherein the timed porting events are exhaust porting events.

43. The internal combustion engine as claimed in claim 41, wherein the timed porting events are all porting events.

44. The internal combustion engine as claimed in claim 34, wherein timing of porting events during the cycle of piston movement is controllable by reciprocation of the reciprocatable sleeve.

45. The internal combustion engine as claimed in claim 44, wherein the timed porting events are exhaust porting events.

46. The internal combustion engine as claimed in claim 44, wherein the timed porting events are all porting events.

47. The internal combustion engine as claimed in claim 40, wherein timing of porting events during the cycle of piston movement is controllable by reciprocation of the reciprocatable sleeve.

48. The internal combustion engine as claimed in claim 47, wherein the timed porting events are exhaust porting events.

49. The internal combustion engine as claimed in claim 47, wherein the timed porting events are all porting events.

* * * * *